US007958675B2

(12) United States Patent
Stull

(10) Patent No.: US 7,958,675 B2
(45) **Date of Patent: *Jun. 14, 2011**

(54) GATE SUPPORT DEVICE

(75) Inventor: Edward J. Stull, Oxford, MI (US)

(73) Assignee: Turnstyle Intellectual Property, LLC, Georgetown, SC (US)

( * ) Notice: Subject to any disclaimer, the term of this patent is extended or adjusted under 35 U.S.C. 154(b) by 965 days.

This patent is subject to a terminal disclaimer.

(21) Appl. No.: 11/691,647

(22) Filed: Mar. 27, 2007

(65) Prior Publication Data

US 2007/0221904 A1 Sep. 27, 2007

Related U.S. Application Data

(60) Provisional application No. 60/786,231, filed on Mar. 27, 2006, provisional application No. 60/831,900, filed on Jul. 19, 2006.

(51) Int. Cl.
*E05F 11/00* (2006.01)

(52) U.S. Cl. ..... 49/324; 49/42; 49/333; 256/73

(58) Field of Classification Search ..... 49/42, 324, 49/381, 397, 236, 326, 334, 333; 256/73
See application file for complete search history.

(56) References Cited

U.S. PATENT DOCUMENTS

| | | | |
|---|---|---|---|
| 28,205 | A | 5/1860 | Sill |
| 163,084 | A | 5/1875 | Krom |
| 203,575 | A | 5/1878 | Arnn |
| 326,548 | A | 9/1885 | Crowfoot |
| 363,964 | A | 5/1887 | Philpott |
| 447,819 | A | 3/1891 | Gorham |
| 571,237 | A | 11/1896 | Philpott |
| 780,623 | A | 1/1905 | Sisk |
| 911,694 | A | 2/1909 | Ashley |
| 920,305 | A | 5/1909 | Finch |

(Continued)

FOREIGN PATENT DOCUMENTS

| | | |
|---|---|---|
| DE | 3513666 | 10/1986 |

(Continued)

OTHER PUBLICATIONS

International Search Report and Written Opinion for PCT/US2009/032538 mailed on Jun. 11, 2009.

(Continued)

*Primary Examiner* — Jerry Redman
*Assistant Examiner* — Catherine A Kelly
(74) *Attorney, Agent, or Firm* — Carlson, Gaskey & Olds, P.C.

(57) ABSTRACT

A support post includes an inner post that supports rotation of an outer post. The inner post includes a journal assembly that supports and facilitates rotation about a central axis. The journal assembly that supports the outer post on the inner post includes a single ball bearing disposed along the axis of rotation. The inner post is fixed and supports a central post on which the ball bearing is supported. The outer post includes a sleeve that fits over the ball bearing and the central post. Support of the outer post along the central axis provides for improved mounting and gate support. An actuator can be utilized to automatically or remotely open the gate. The actuator is disposed within the inner post that drives rotation of the outer post. The outer post remains supported by the journal assembly and is rotated by the actuator with the inner post.

19 Claims, 6 Drawing Sheets

U.S. PATENT DOCUMENTS

| | | | | | |
|---|---|---|---|---|---|
| 933,677 | A | | 9/1909 | Smith | |
| 1,126,067 | A | | 1/1915 | Nolte | |
| 1,221,796 | A | | 4/1917 | Egbert | |
| 1,383,961 | A | | 7/1921 | Melugin | |
| 1,462,766 | A | | 7/1923 | Post | |
| 1,494,911 | A | | 5/1924 | Heselschwerdt | |
| 1,540,490 | A | | 6/1925 | Mertel | |
| 1,891,739 | A | | 12/1932 | Wenger | |
| 2,151,052 | A | * | 3/1939 | Smart et al. | 49/239 |
| 2,181,464 | A | | 11/1939 | Renner | |
| 2,564,485 | A | | 8/1951 | Kurstin et al. | |
| 3,626,547 | A | | 12/1971 | Werner | |
| 4,122,630 | A | | 10/1978 | Parisien | |
| 4,472,908 | A | | 9/1984 | Wanzl et al. | |
| 4,649,597 | A | | 3/1987 | Cacicedo | |
| 4,665,650 | A | * | 5/1987 | Hall | 49/334 |
| 4,731,886 | A | | 3/1988 | Heinrich et al. | |
| 4,813,293 | A | | 3/1989 | Fink | |
| 5,035,082 | A | | 7/1991 | Butler | |
| 5,036,620 | A | * | 8/1991 | Beran et al. | 49/141 |
| 5,133,152 | A | | 7/1992 | Grancagnolo | |
| 5,138,796 | A | * | 8/1992 | Grainger | 49/238 |
| 5,215,290 | A | * | 6/1993 | Khalessi | 256/19 |
| 5,277,488 | A | | 1/1994 | Cleary et al. | |
| 5,373,664 | A | | 12/1994 | Butler | |
| 6,990,772 | B2 | * | 1/2006 | Eckel et al. | 49/236 |
| 7,506,860 | B2 | * | 3/2009 | Stull | 256/73 |
| 2005/0156149 | A1 | * | 7/2005 | Stull | 256/73 |
| 2008/0237561 | A1 | | 10/2008 | Cozby | |

FOREIGN PATENT DOCUMENTS

| | | |
|---|---|---|
| DE | 20121216 | 6/2002 |
| EP | 0152210 | 8/1985 |
| EP | 0743464 | 11/1996 |
| EP | 1143096 | 10/2001 |
| GB | 585176 | 1/1947 |
| JP | 10-169342 | 6/1998 |
| JP | 11-62444 | 3/1999 |
| JP | 11-131954 | 5/1999 |
| WO | 02/18737 | 3/2002 |
| WO | 2005/073494 | 8/2005 |

OTHER PUBLICATIONS

International Search Report and Written Opinion mailed on Oct. 1, 2007.

International Search Report dated May 12, 2005.

International Preliminary Report on Patentability for PCT/US2008/066847 mailed on Dec. 30, 2009.

* cited by examiner

GATE SUPPORT DEVICE

CROSS REFERENCE TO RELATED APPLICATION

The application claims priority to U.S. Provisional Application No. 60/786,231 filed on Mar. 27, 2006 and 60/831,900 filed on Jul. 19, 2006.

BACKGROUND OF THE INVENTION

This invention generally relates to a device for supporting a movable gate. More particularly, this invention relates to an easily installable device for supporting movement of a gate between a closed and an open position.

Typically, a fenced in area includes a closable gate for controlling entry and exit. Fenced in areas are utilized to restrict access to specific areas for safety and security reasons, such as for example a construction site. The gate is typically supported on a post disposed on one side of the opening. The gate hangs off the post in a cantilever manner such that the gate creates a force acting to tip the post to one side. For this reason, the post onto which a gate is supported is typically reinforced in some manner to prevent tipping. As appreciated, tipping can cause undesirable mis-alignment of the gate within the opening.

Conventional fences and gates are fabricated from wood or metal that is quite durable and robust. However, such materials are expensive, heavy and require significant maintenance. Accordingly, plastic or vinyl fencing is increasing in popularity and use. Plastic or vinyl fencing is lighter, and therefore easier to assembly, and does not require painting or other maintenance required for conventional materials. However, the plastic or vinyl fencing is typically not robust enough to support the weight of a hanging gate. Instead, if a gate is desired, other materials are utilized causing a disruption in the desired appearance, and reducing the benefits provided by utilizing plastic or vinyl fencing.

Accordingly, it is desirable to develop and design a gate support device that simplifies installation, is compatible with all types of material and that prevents undesirable tipping or mis-alignment of the gate without the need for extensive reinforcement.

SUMMARY OF THE INVENTION

An example support post includes an inner post that supports rotation of an outer post. The inner post includes a journal assembly that supports and facilitates rotation about a central axis.

The example support post includes a journal assembly that supports an outer post on an inner post. The journal assembly includes a single ball bearing disposed along the axis of rotation. The inner post is fixed and supports a central post on which the ball bearing is supported. The outer post includes a sleeve that fits over the ball bearing and the central post. Support of the outer post along the central axis provides for improved mounting and gate support.

An actuator can be utilized to automatically or remotely open the gate. An example gate post includes an actuator disposed within the inner post and hidden from view that drives rotation of the outer post. The outer post remains supported by the journal assembly and is rotated by the actuator with the inner post.

These and other features of the present invention can be best understood from the following specification and drawings, the following of which is a brief description.

DESCRIPTION OF THE PREFERRED EMBODIMENT

Figure 1:
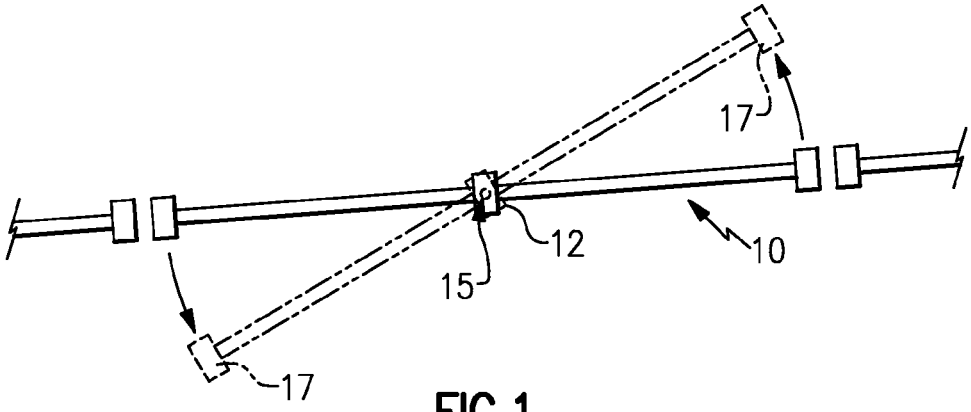
FIG. 1 a top schematic view of an example gate assembly.
Figure 2:
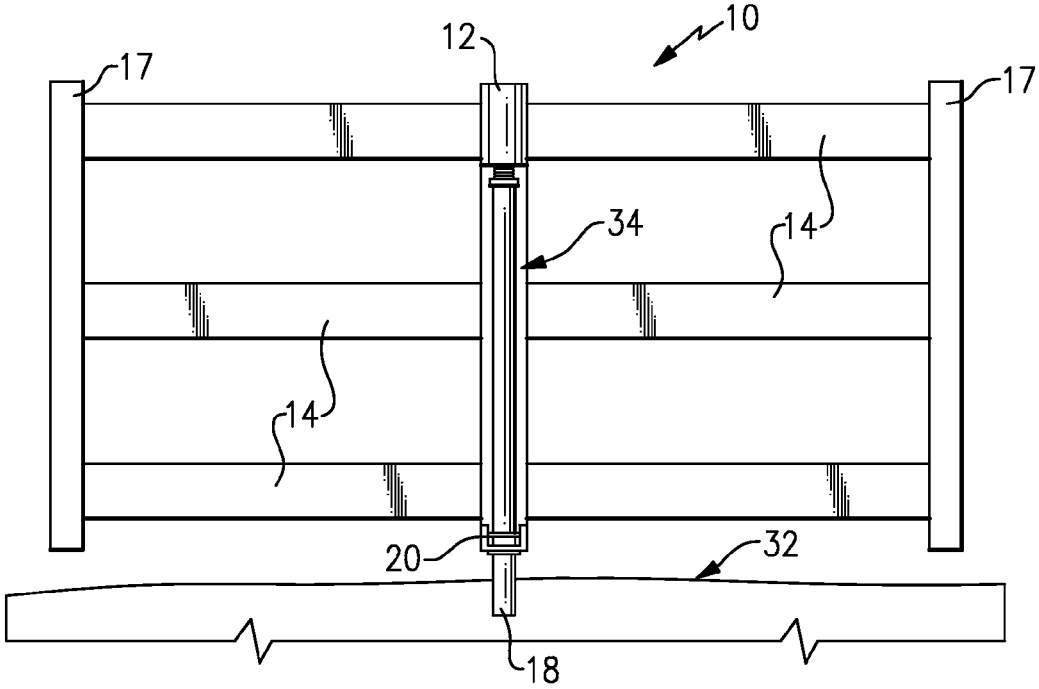
FIG. 2 is a front view of an example gate assembly.

Referring to FIGS. 1 and 2, a gate assembly 10 includes a center post 12 that is supported by a gate inner post 34 for rotation about a central axis 15. Rotation of the gate assembly 10 facilitates opening and closing of a space within a complete gate structure.

Extending outwardly from the center post 12 are rails 14 that are attached to and support outside posts 17. The gate assembly 10 is rotatable about the inner post 34 to allow access to an enclosed area. The inner post 34 is attached to a ground mount 18 that is fixed within the ground 32. The ground mount 18 includes an adjustment bracket 20 for securing the support post 16 to the ground mount 18. The adjustment bracket 20 also facilitates adjustment and orientation of the inner post 34 that provide for adjusting the gate assembly 10 within the opening as desired.

Figure 3:
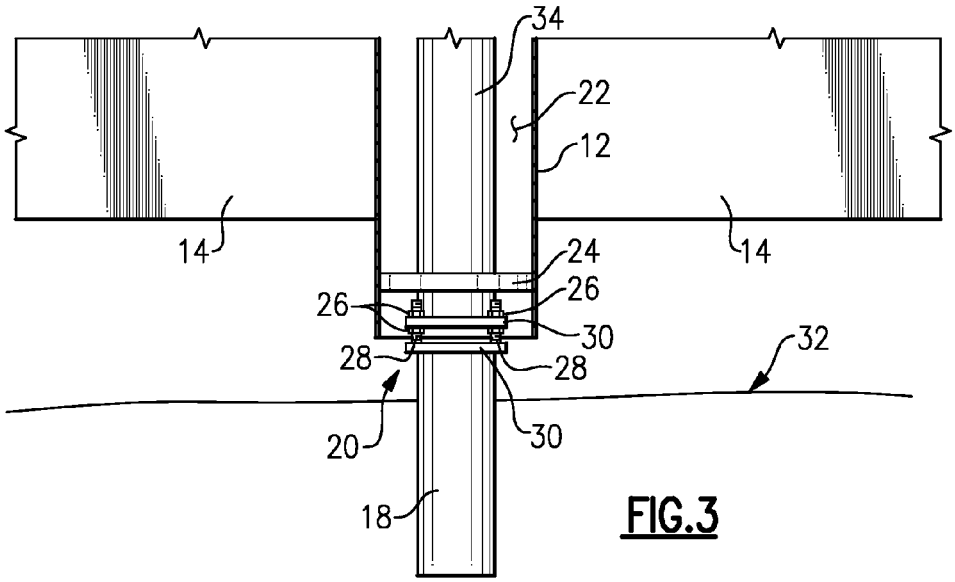
FIG. 3 is an enlarged view of an example ground support member.

Referring to FIG. 3, the ground mount 18 is fixed within the ground 32 and includes the adjustment bracket 20. The adjustment bracket 20 includes plates 30, one of which is mounted to the ground mount 18 and the other of which is attached to the inner post 34. The two plates 30 are attached by threaded members 28 that include nuts 26 for adjusting the orientation of the inner post 34, relative to the ground mount 18 and the surrounding fence.

The center post 12 is supported on the inner post 34 and is rotatable relative to that inner post 34 about the central axis 15. A lower support plate 24 is attached to the center post 12 and is rotatable about the inner post 34. The lower support plate 24 is fabricated from a material that provides low friction to allow the easy rotation of the center post 12 relative to the inner post 16.

Figure 4:
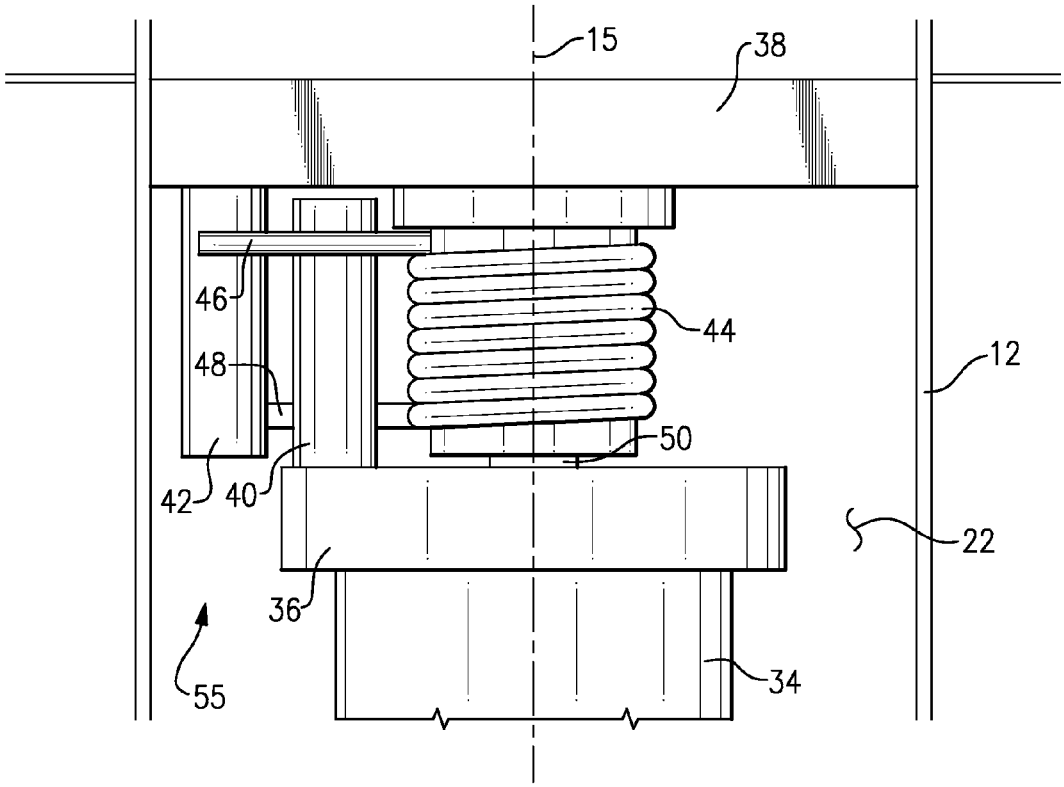
FIG. 4 is an enlarged view an example journal bearing assembly.
Figure 5:
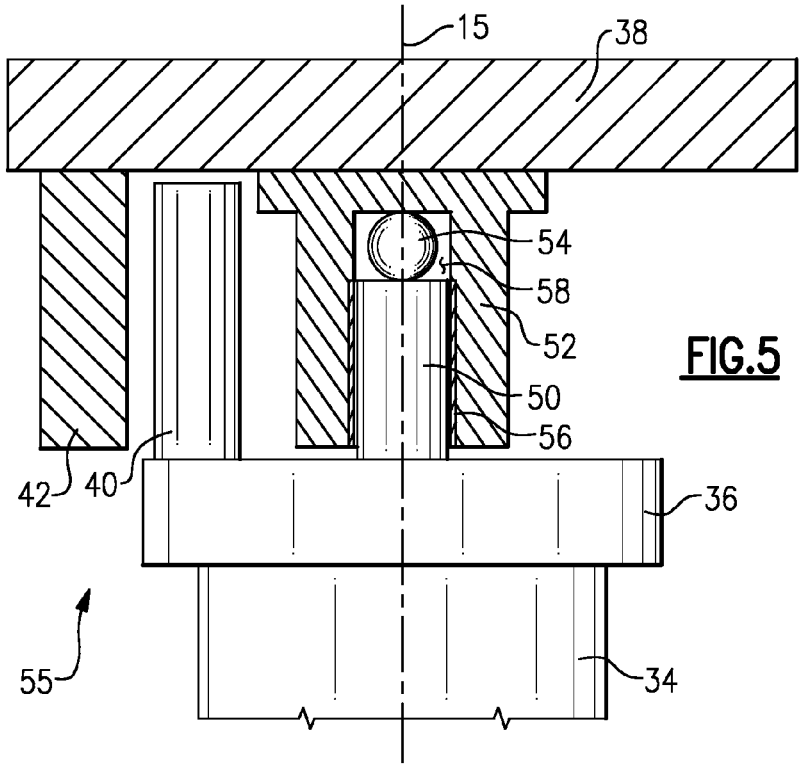
FIG. 5 is a cross-section of the example journal bearing assembly.

Referring to FIGS. 4 and 5, the inner post 34 supports a journal assembly 55 that facilitates support of the gate assembly 10 and rotation about the central axis 15. The journal assembly 55 includes a fixed plate 36 attached to the inner post 34 and a rotatable plate 38 attached to the center post 12. A central support 50 extends from the fixed support plate 36 along the central axis 15. A single ball bearing 54 is disposed atop the central support 50. A sleeve 52 extends from the rotatable plate 38 and over the ball bearing 54 and the central support 50. The sleeve 52 defines a cavity 58 within which the ball bearing 54 is disposed. The weight of the gate assembly 10 is supported on the single ball bearing 54 along the central axis 15. The sleeve 52 includes a bearing surface 56 that is comprised of a low friction material to facilitate rotation about the central support 50.

The rotatable plate 38 attaches to the post 12 and is larger than the inner post 34 and fixed plate 36. The center post 12 is attached to an outer periphery of the rotatable plate 38. Rotation of the gate assembly 10 and thereby the center post 12 is facilitated by rotating the rotatable plate 38 relative to the fixed plate 36 that is fixed to the inner post 34. The example inner post 34 does not rotate, however the rotatable support plate 38 rotates on the ball bearing 54 that is disposed on the central support 50. The example gate assembly 10 is thereby centered on the ball bearing 50 which in turn supports the weight of the gate assembly 10.

A fit between the sleeve 52 and the central support 50 is a running clearance fit that provides the stable rotation of the gate assembly 10 about the central axis 15. The bearing 54 provides the desired fit between the sleeve 52 and the cavity 58. The bearing 54 also provides a low friction, high durability surface desired to provide for the rotation of the gate assembly 10 relative to the inner post 34.

The example journal assembly 55 also includes a self-closing biasing device. The self-closing biasing device includes a biasing member 44 disposed about the sleeve 52. The biasing member 44 facilitates the selective rotation of the gate assembly 10 back to a desired position. The biasing member 44 includes arms 46, 48 that engage corresponding legs extending from the first support plate 36 and the second support plate 38. The fixed plate 36 includes the first leg 40 and the rotatable plate 38 includes the second leg 42. Rotation of the rotatable plate 38 relative to first support plate 36 causes the biasing member 36 to engage one of the posts 40, 38. Upon release of the gate assembly, the biasing member will move the gate assembly 10 back to a desired position. In this manner, the gate assembly 10 is provided with an automatic return mechanism that provides for the positioning of the gate in a desired opening to block access and control ingress and egress.

The inner post 34 is disposed within a hollow cavity of the center post 12. The gate structure is preferably fabricated from a plastic of vinyl material that includes a hollow section. Other material may also be utilized with this invention. However other materials such as wood and metal do not typically include the hollow cavity that is provided by commercially available vinyl and plastic fencing.

Vinyl and plastic fencing is designed in such a manner as to provide easy installation. However, the vinyl fencing does not provide the required strength to support a gate assembly in a cantilevered manner. Accordingly, the inner post 34 disposed within the hollow cavity of the center post 12 at the center portion of the gate assembly provides a balanced gate that can be installed with most commercially available plastic or vinyl fencing.

Figure 6:
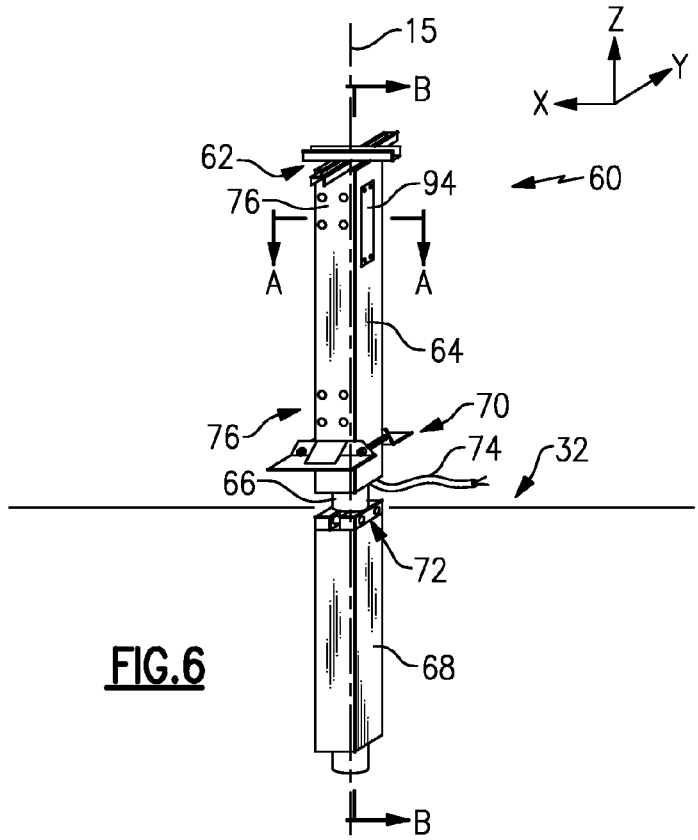
FIG. 6 is a perspective view of an example powered gate post assembly.

Referring to FIG. 6, an example powered gate post assembly 60 provides for the automatic or remote operation of a gate and includes an inner post 66 that is received within a ground sleeve 68 and supports an outer post 64. The ground sleeve 68 includes a rotational adjustment bracket 72 for adjusting the rotational position of the post assembly 60. The rotational position of the post assembly is infinitely adjustable by adjusting a position of the rotational adjustment bracket 72. Further, loosening the rotational adjustment bracket 72 allows free swinging of the gate by allowing the post assembly 60 to freely rotate within the ground sleeve 68. This provides for operation in the event of a power failure.

Additionally, the rotation adjustment bracket 72 provides for the conversion of the gate from opening inwardly, to opening outwardly, and vice-versa. Loosening the adjustment bracket and rotating the gate and the post assembly 60 provides reorients the start position of the gate to provide inward or outward opening as desired.

The outer post 64 includes a top adjustment bracket 62 for adjusting a gate within and X and Y plane. A lower adjustment bracket 70 provides for attachment of a gate and also adjustment of a height of the gate. The outer post 64 also includes a plurality of mounting holes 76 that facilitate different mounting configurations of a gate. An access plate 94 is removable to provide access to an actuator that powers the gate post assembly 60. A power lead wire 74 extends from within the outer post 64 to supply electric power as desired.

Figure 7:
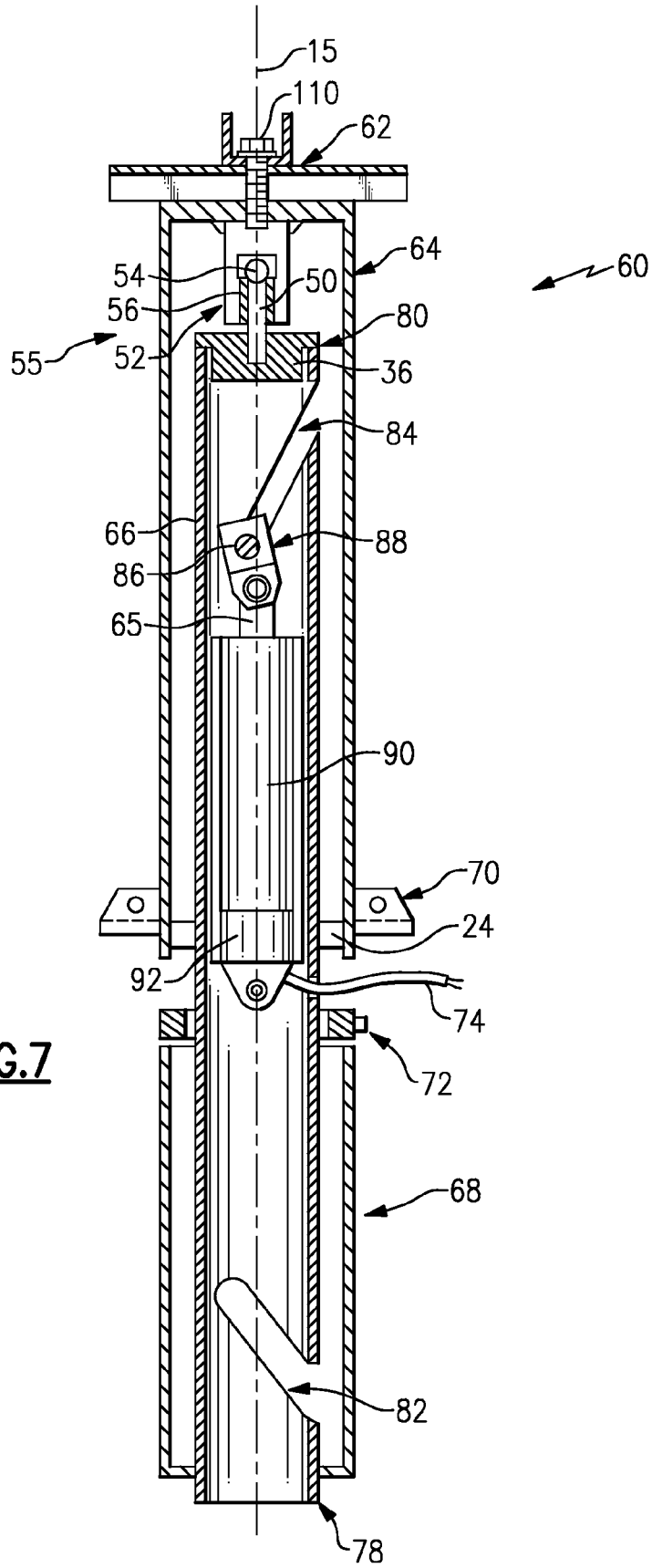
FIG. 7 is a cross-sectional view of the powered gate post assembly.
Figure 8:
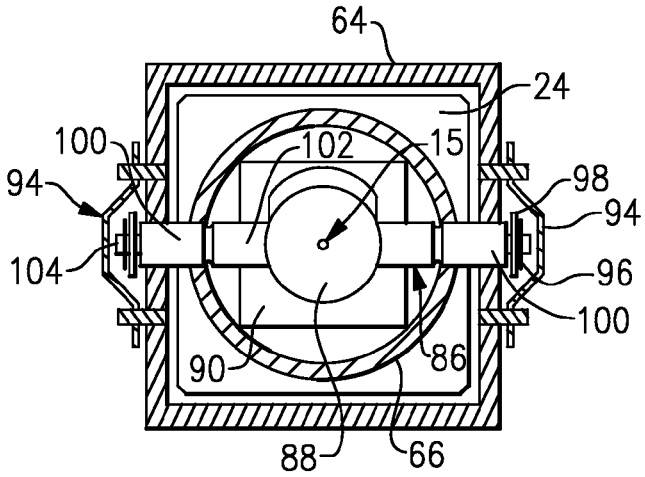
FIG. 8 is cross-sectional view of the powered gate post assembly.

Referring to FIG. 7, the powered post assembly 60 includes an actuator 90 that drives a drive pin 86 disposed within a first drive slot 84. The actuator 90 is disposed entirely within the inner post 66 and therefore hidden from view. A trunion 88 links the actuator 90 to the drive pin 86. The actuator 90 is mounted to the inner post 66 and the drive pin 86 is movable within the first drive slot 84 and engaged to the outer post 64 (FIG. 8).

The example actuator 90 is a linear actuator that includes a ball screw shaft 65. The ball screw shaft 65 is attached to the trunion 88. The trunion 88 extends between sides of a rotating post member 64. Movement of the actuator 90 linearly moves the drive pin 86 within the drive slot 84 to cause a corresponding rotation of the outer post 64. A controller 92 can be included within the inner post 66 along with the actuator 90 to facilitate wireless control and actuation of the actuator 90. The drive slot 84 includes an orientation that twists the drive pin 86 for rotation about the axis 15.

The inner post 66 includes a first end 80 and a second end 78. The second end includes a second drive slot 82. The first drive slot 84 provides rotation of the outer post 64 in a first direction and the second drive slot 82 provides rotation of the outer post 64 in a second direction. During installation, the inner post 66 is installed with the drive slot 84, 82 out of the ground sleeve 68 that corresponds to the desired direction of rotation. The other drive slot 84, 82 and end is received within the ground sleeve 68. In this way, only one inner post configuration is required to accommodate rotation and opening of the gate in either a clockwise or counterclockwise direction.

The powered post assembly 60 includes the outer post 62 that rotates about the inner post 66. The example outer post member 64 is fabricated from a plastic or a vinyl fence structure that includes a hollow inner cavity. The hollow inner cavity effectively conceals the entire inner post 90 and actuation and support features. All of the powered assembly features are hidden from view within the inner post 66.

Additionally, a prefabricated gate structure can be attached to the rotating post 64. In this manner an existing wood, or plastic panel structure that is obtained as a prefabricated unit can be supported for use as a gate. The post assembly 60 can therefore be utilized for gate structures of a many differing configurations and materials. Attachment of the prefabricated gate panel can be accomplished utilizing any known fastener. Further, support features can be attached to the post 60 to support gates of desired configurations to adapt to application specific requirements.

The entire powered post assembly 60 and thereby the entire gate is easily removable from the ground sleeve 68 to facilitate opening of the entire gate opening. Further, the easy removal from the ground sleeve 68 is facilitated by loosening the rotational position bracket 72. The easy removal with one connection provides many advantages by allowing easy adjustment, removal and re-installation.

Referring to FIG. 8, a cross-sectional view through the drive pin 86 illustrates engagement to the outer post 64. The outer post 64 includes an opening for ends of the drive pin 86 that are covered by an access panel 104. The ends of the drive pin 86 extend through each wall of the outer post 64 and are retained by a washer 98 and clip 96. The trunion 88 attaches and drives the drive pin 86 upward in the drive slot 84. Because of the arcuate shape of the drive slot 84, upward movement creates a rotation that is translated to the outer post 64.

Figure 9:
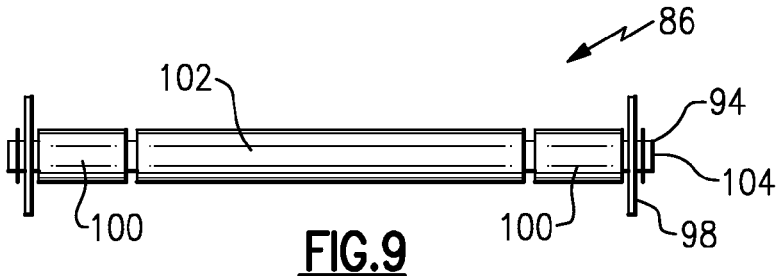
FIG. 9 is a view of an example drive pin assembly.

Referring to FIG. 9, with continued reference to FIG. 8, the example drive pin 86 includes a shaft 104 that supports bearings 100 and a sleeve 102. The bearings 100 are disposed within the walls of the outer post 64 and facilitate relative rotation of the outer post 64. The sleeve 102 is engaged and supported by the trunion 88.

Figure 10:
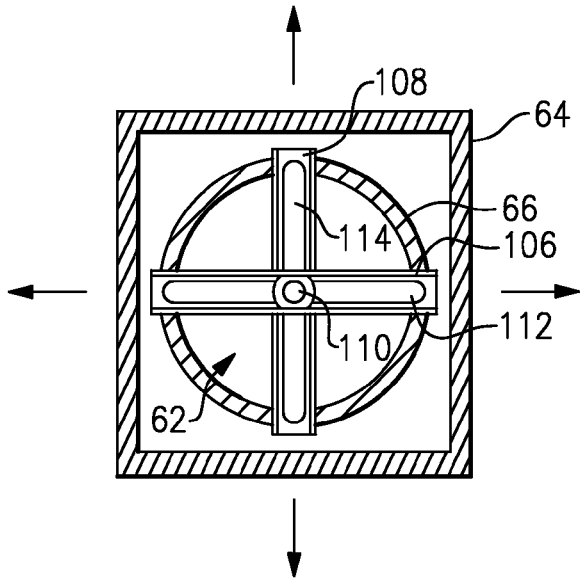
FIG. 10 is a top view of an example top adjustment bracket.

Referring to FIG. 10, the top adjustment bracket 62 includes a first bracket 106 and a second bracket 108 that are attached to the rotatable plate by a fastener 110. Each of the first and second brackets 106 and 108 include a slot 112,114 that provide for relative sliding to align the gate as desired.

Figure 11:
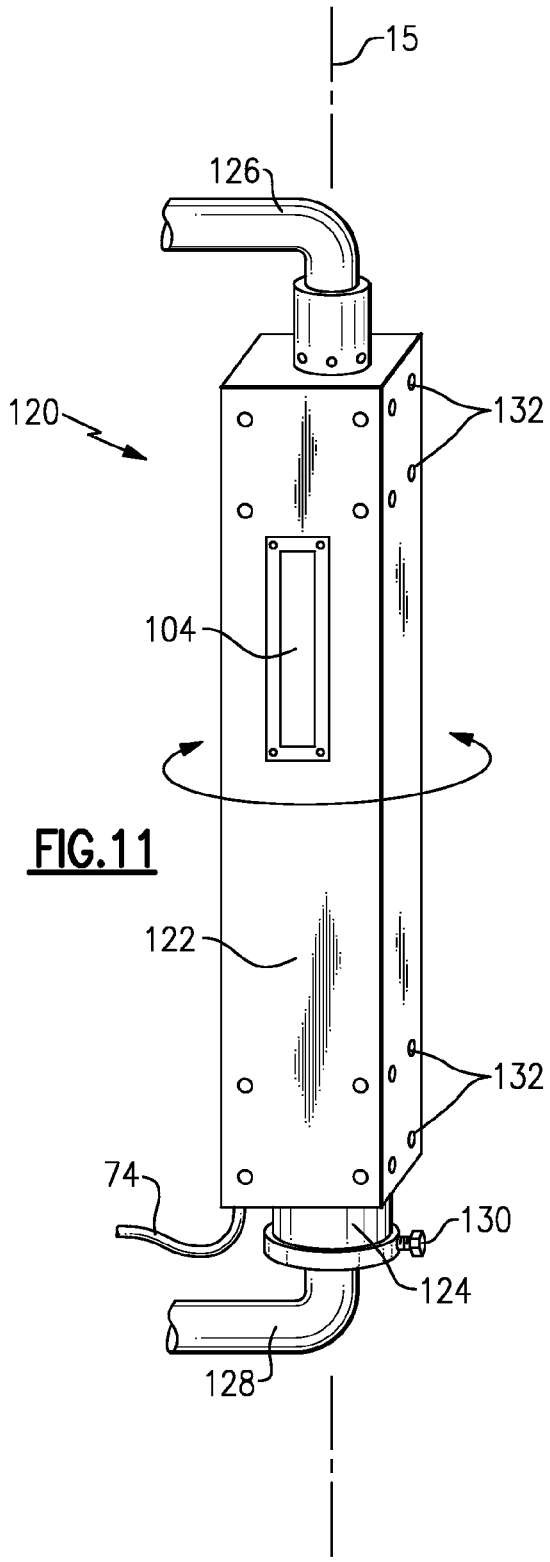
FIG. 11 is a perspective view of another example powered gate support assembly.

Referring to FIG. 11, another example powered gate post assembly 120 is configured for mounting to a fixed structure. The post assembly 120 includes an inner post 124 that supports an outer post 122. A top bracket 126 and a bottom bracket 128 provides for mounting to a post or other fixed structure. The outer post 122 rotates relative to the inner post 124 about the axis 15. The outer post includes an access panel 104 to provide access to the inner actuation mechanism. A rotational position is adjustable by loosening the fastener 130 and rotating the inner post 124 into a desired position. Once in the desired location the fastener is tightened to maintain the desired position. The outer post 122 includes a plurality of mounting hole patterns 132 for attaching any desired gate configuration or structure.

Referring to FIGS. 7 and 8, operation the post assembly 60 begins in a desired closed position. Actuation of the actuator 90 causes trunion 88 to raise or lower. Raising or lowering the trunion 88 causes movement of the drive pin 86 within the drive slot 84. The drive slot 84 includes the desired shape that translates upward movement into a corresponding rotational movement of the rotating post 64. The rotating post 64 causes a corresponding movement of the gate assembly 10.

Figure 12:
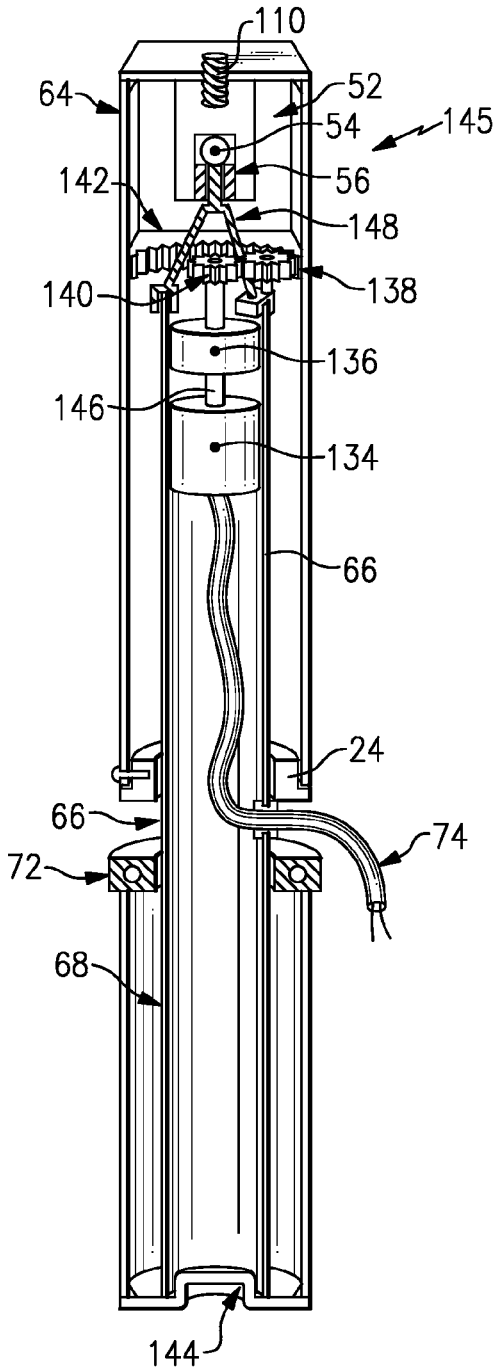
FIG. 12 is a cross-section of another example powered gate support assembly.

Referring to FIG. 12, another example power post 145 includes an electric motor 134 that drives a shaft 146 that includes a pinion drive gear 140. The pinion drive gear 140 is part of a gear train 138 that also includes an outer ring gear 142. The motor 134 drives the shaft 146 through a torque converter 136 to rotate the outer post 64 relative to the inner post 66. The journal assembly 52 is supported atop the inner post 66 by a support member 148. Rotation of the motor 134 causes a rotation of the outer post through the gear train 148. The specific gear ration of each of the gears within the drive train provides a desired speed of opening a gate.

The ground sleeve 68 of this example includes a locator plug 144 that receives the inner post 66 to provide a desired axial location. The inner post 66 is adjustable rotationally by the rotational adjustment bracket 72.

As appreciated, although a linear actuator 90, and a rotary electric motor 134 are illustrated, other actuators that can provide for the rotation of the gate assembly are also within the consideration of this invention. Further, a passive device may be utilized to provide for returning and rotating the gate to a desired position. The passive device may be, for example, a pneumatic or hydraulic dampening mechanism.

Accordingly, a gate assembly according to this invention provides for the use of alternate materials such as plastic or vinyl fencing without complicated or use of heavy conventional materials or complex reinforcing. The journal assembly provides for the use of lower power motors that in turn allow complete installation of the drive system within the inner post. Further, the example power post is both the hinge, the gate support and the actuator and therefore does not require any further hinges or mounting devices. Additionally, the gate assembly according to this invention conceals the support assembly within the plastic or vinyl gate material or fixtures to maintain the desired uniform appearance provided by the plastic or vinyl fencing.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A power actuated gate post assembly comprising:

an inner post including first and second open ends and an open inner space;

an outer post rotatable about the inner post;

a journal bearing assembly supported between the inner post and the outer post including a ball bearing centered along an axis of rotation of the outer post, wherein the ball bearing supports the outer post on the inner post; and an actuator disposed within the inner post, wherein said actuator selectively rotates the outer post relative to the inner post, wherein the outer post remains supported on the ball bearing during rotation relative to the inner post such that a relative axial position between the inner post and the outer post remains constant.

2. The assembly as recited in claim 1, wherein the journal bearing assembly comprises a support attached to one of the inner post and the outer post and a sleeve attached to the other of the inner post and the outer post with the ball bearing disposed between the support and the sleeve.

3. The assembly as recited in claim 2, wherein the inner post includes a first drive slot and the actuator drives a drive pin movable within the drive slot for rotating the outer post relative to the inner post.

4. The assembly as recited in claim 3, wherein the drive pin extends from the drive slot and engages the outer post.

5. The assembly as recited in claim 3, wherein the actuator comprises a linear actuator.

6. The assembly as recited in claim 1, including a ground sleeve for installation into the ground, wherein a portion of the inner post is received within the ground sleeve.

7. The assembly as recited in claim 1, wherein the outer post includes an adjustment bracket for attaching and positioning a gate as desired.

8. The assembly as recited in claim 3, wherein the first drive slot is disposed near the first end and a second drive slot is disposed near the second end, wherein the first drive slot facilitates rotation of the outer post in a first direction and the second drive slot facilitates rotation of the outer post in a second direction opposite the first direction and the drive pin is disposed in one of the first drive slot and the second drive slot dependent on a desired rotation of the outer post and the other of the first drive slot and the second drive slot is mounted within a ground sleeve.

9. The assembly as recited in claim 1, wherein the actuator comprises an electric motor that drives a gear train for rotating the outer post relative to the inner post.

10. A powered post for supporting and opening a gate comprises:

an inner post fixed relative to movement of the gate;

an outer post supported for movement about an axis of rotation on the inner post, wherein the gate is attached to the outer post;

a journal bearing assembly for supporting the outer post and the gate that is attached to the inner post, wherein the journal bearing assembly includes a ball bearing centered along the axis of rotation; and an actuator attached to the inner post, wherein said actuator moves the outer post, wherein the inner post includes a drive slot and the actuator includes a drive pin movable within the drive slot rotating the outer post relative to the inner post while maintaining support of the outer post on the ball bearing that is supported on the inner post.

11. The assembly as recited in claim 10, wherein the gate includes a hollow post that fits over and attaches to the outer post.

12. The assembly as recited in claim 11, wherein the gate and the hollow post comprises one of a plastic and vinyl material.

13. A method of supporting the gate assembly as recited in claim 1 comprising the steps of:

a) installing a ground sleeve within the ground;

b) inserting the inner post within the ground sleeve;

c) installing the outer post over the inner post by supporting the outer post on the journal bearing supported on the inner post, wherein the journal bearing includes the ball bearing disposed on the axis of rotation;

d) attaching the gate to the outer post;

e) rotating the inner post within the ground sleeve to align the gate as desired and securing the inner post to the ground sleeve once in the desired position; and f) aligning the gate horizontally as desired with an adjustment bracket attached to the outer post.

14. The method as recited in claim 13, including the step of installing a biasing member having first and second arms onto the inner post relative to a first leg on the outer post and a second leg on the inner post to facilitate automatic return of the gate assembly to a desired position.

15. The method as recited in claim 13, including installation of a powered actuator for moving the outer post relative to the inner post, wherein the installation of the power actuator includes the steps of determining in which direction it is desired that the gate rotate to an open position, selecting one of a first and second ends of the inner post that includes a drive slot corresponding to the determined desired direction, inserting the other of the first and second ends into the ground sleeve and assembling a drive pin into the drive slot and attaching the drive pin to the outer post.

16. The method as recited in claim 13, wherein the step of attaching a gate to the outer post includes inserting a hollow post made from a plastic or vinyl material over the outer post and securing a top portion of the hollow post to the adjustment bracket and supporting a bottom portion of the post with a height adjustment bracket attached to the outer post.

17. The assembly as recited in claim 1, wherein the ball bearing remains in load bearing contact with the inner post during rotation of the outer post relative to the inner post.

18. The assembly as recited in claim 10, wherein the ball bearing remain in load bearing contact with the inner post during rotation of the outer post relative to the inner post.

19. The assembly as recited in claim 10, wherein the outer post maintains a fixed vertical position relative to the inner post during rotation about the axis of rotation.

* * * * *